US007775005B2

(12) United States Patent
Johnston et al.

(10) Patent No.: US 7,775,005 B2
(45) Date of Patent: Aug. 17, 2010

(54) VENT PIPE COVERING SYSTEM

(76) Inventors: Lorne G. Johnston, Box 5731 Station Main, High River, AB (CA) T1V 1P3; Mona A. Bareham, Box 5731 Station Main, High River, AB (CA) T1V 1P3

( * ) Notice: Subject to any disclaimer, the term of this patent is extended or adjusted under 35 U.S.C. 154(b) by 280 days.

(21) Appl. No.: 11/877,759

(22) Filed: Oct. 24, 2007

(65) Prior Publication Data

US 2008/0098673 A1 May 1, 2008

Related U.S. Application Data

(60) Provisional application No. 60/854,363, filed on Oct. 26, 2006.

(51) Int. Cl.
*E04D 13/14* (2006.01)
*E04B 7/00* (2006.01)
*E04H 12/28* (2006.01)

(52) U.S. Cl. ..... 52/219; 52/244; 52/198; 52/58; 285/44

(58) Field of Classification Search ..... 52/58, 52/218, 219, 244, 101, 300, 301, 198; 285/42, 285/43, 44
See application file for complete search history.

(56) References Cited

U.S. PATENT DOCUMENTS 558,025 A * 4/1896 Barry, Jr. ..... 285/44
1,254,292 A 1/1918 Swenson
1,261,276 A 4/1918 Norton
1,279,572 A 9/1918 Moore
1,317,574 A * 9/1919 Grosvold ..... 285/44
1,334,386 A 3/1920 Edward
1,464,406 A 8/1923 Butler
1,587,250 A 6/1926 Stephenson
1,678,715 A 7/1928 Stephenson
1,923,220 A * 8/1933 Lightbown ..... 285/13
3,313,559 A 4/1967 Kifer
3,602,530 A 8/1971 Elwart
3,731,952 A 5/1973 Elwart
3,797,181 A * 3/1974 Nievelt ..... 52/105
4,010,578 A 3/1977 Logsdon
4,160,347 A 7/1979 Logsdon
4,265,058 A 5/1981 Logsdon
4,526,407 A 7/1985 Kifer (Continued)

FOREIGN PATENT DOCUMENTS

CA 190291 5/1919

(Continued)

*Primary Examiner*—Richard E Chilcot, Jr.
*Assistant Examiner*—Ryan D Kwiecinski
(74) *Attorney, Agent, or Firm*—Neustel Law Offices

(57) ABSTRACT

A vent pipe covering system for efficiently forming a seal between a vent pipe structure and a supporting structure. The vent pipe covering system generally includes a base, a body extending from the base and a coupler extending from the body opposite the base. The base includes a first opening and the body includes a passageway, wherein the passageway longitudinally extends through the body and interconnects with the first opening. The coupler includes a retaining cavity to extend over an outermost end of a pipe extending through the passageway and the first opening, wherein the body and passageway may expand and retract to accommodate various length pipes via an expandable portion of the body.

4 Claims, 9 Drawing Sheets

U.S. PATENT DOCUMENTS

| | | | | | |
|---|---|---|---|---|---|
| 4,563,847 | A | | 1/1986 | Hasty | |
| 4,570,943 | A | | 2/1986 | Houseman et al. | |
| 4,664,390 | A | | 5/1987 | Houseman | |
| 4,768,812 | A | | 9/1988 | Katz | |
| 4,864,782 | A | | 9/1989 | Hasty | |
| 4,903,997 | A | | 2/1990 | Kifer | |
| 5,010,700 | A | * | 4/1991 | Blair | 52/199 |
| 5,036,636 | A | | 8/1991 | Hasty | |
| 5,176,408 | A | | 1/1993 | Pedersen | |
| 5,245,804 | A | * | 9/1993 | Schiedegger et al. | 52/199 |
| 5,347,776 | A | * | 9/1994 | Skoff | 52/219 |
| 5,390,451 | A | * | 2/1995 | Kopp et al. | 52/58 |
| 5,588,267 | A | | 12/1996 | Rodriguez et al. | |
| 5,694,724 | A | * | 12/1997 | Santiago | 52/219 |
| 5,778,611 | A | * | 7/1998 | Michel | 52/198 |
| 5,860,256 | A | | 1/1999 | Humber | |
| 6,244,006 | B1 | * | 6/2001 | Shue et al. | 52/302.1 |
| 6,279,272 | B1 | * | 8/2001 | Nill, Jr. | 52/58 |
| 2003/0024185 | A1 | * | 2/2003 | Menzies | 52/219 |
| 2005/0055889 | A1 | | 3/2005 | Thaler | |
| 2006/0130411 | A1 | | 6/2006 | Edgar et al. | |
| 2007/0101664 | A1 | * | 5/2007 | Hoy et al. | 52/198 |
| 2008/0040987 | A1 | * | 2/2008 | Dreisacker | 52/101 |

FOREIGN PATENT DOCUMENTS

| | | |
|---|---|---|
| CA | 203681 | 9/1920 |
| CA | 203721 | 9/1920 |
| CA | 221273 | 7/1922 |
| CA | 224981 | 10/1922 |
| CA | 243331 | 9/1924 |
| CA | 244286 | 11/1924 |
| CA | 270242 | 5/1927 |
| CA | 275421 | 11/1927 |
| CA | 275611 | 11/1927 |
| CA | 278454 | 3/1928 |
| CA | 294901 | 11/1929 |
| CA | 301139 | 6/1930 |
| CA | 324659 | 8/1932 |
| CA | 366116 | 5/1937 |
| CA | 723351 | 12/1965 |
| CA | 740771 | 8/1966 |
| CA | 1160658 | 1/1984 |
| CA | 1161879 | 2/1984 |
| CA | 1225193 | 8/1987 |
| CA | 1285191 | 6/1991 |
| CA | 1290914 | 10/1991 |
| CA | 1298007 | 3/1992 |
| CA | 2187666 | 10/1995 |
| CA | 2153732 | 1/1997 |
| CA | 2292716 | 7/2000 |
| CA | 2227058 | 1/2002 |
| CA | 2363360 | 5/2003 |
| CA | 2440420 | 9/2003 |
| CA | 2491491 | 1/2004 |
| CA | 2119583 | 7/2004 |
| CA | 2104172 | 11/2004 |
| CA | 2452668 | 3/2005 |
| CA | 2187118 | 6/2005 |
| CA | 2508991 | 12/2005 |
| CA | 2177104 | 2/2008 |
| GB | 2155135 | 9/1985 |

* cited by examiner

VENT PIPE COVERING SYSTEM

CROSS REFERENCE TO RELATED APPLICATIONS

I hereby claim benefit under Title 35, United States Code, Section 119(e) of U.S. provisional patent application Ser. No. 60/854,363 filed Oct. 26, 2006. The 60/854,363 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to vent pipes and more specifically it relates to a vent pipe covering system for efficiently forming a seal between a vent pipe structure and a supporting structure.

2. Description of the Related Art

Any discussion of the related art throughout the specification should in no way be considered as an admission that such related art is widely known or forms part of common general knowledge in the field.

Vent pipes have been in use for years and are utilized among buildings and homes to provide a means for releasing gases from within the building or home. During construction of homes in approximately the late 1800's to late 1900's a vent pipe structure 20 as illustrated in FIG. 5 was commonly utilized. The vent pipe structure 20 many times included of a main pipe 21 extending through a vent opening 13 of the support structure 12 (i.e. roof, side of building, etc.). In the preferred embodiment, the support structure 12 is comprised of a roof and includes various roofing materials, such as trusses and plywood common to the construction of a roof; however it is appreciated that the support structure 12 may be comprised of various structures, such as but not limited to outer walls of buildings, floors or various other supporting structures.

The main pipe 21 also generally extends through an opening of a flashing 25, wherein the flashing 25 is generally attached upon an outer surface 14 of the support structure 12 on the outer edges of the flashing 25 and between a hub 23 and the extension pipe 22 around the perimeter of the central opening of the flashing 25. Since the main pipe 21 is extended from the plumbing structure within the house, the main pipe 21, at many times, is extended at inconsistent distances from the outer surface 14 of the support structure 12. The vent pipe structure 20 also generally included the hub 23 attached to an outer end of the main pipe 21 and the extension pipe 22 extending from the hub 23 opposite the main pipe 21.

To provide a seal between the main pipe 21 and the support structure 12, a sealant material 27 was generally positioned within between the central opening of the flashing 25 and the extension pipe 22. The sealant material 27 generally provided a watertight seal so that water or other outside elements would not be able to seep within the building or home between the perimeter of the main pipe 21 and the support structure 12.

Over time, during roof repairs (e.g. re-shingling, etc.) and adjustment or manipulation of the flashing 25, the sealant material 27 often cracks or becomes worn, thus forcing the sealant material 27 (i.e. oakum, etc.) to lose an ability to provide an adequate watertight seal. When the support structure 12 needs to be re-shingled, the shingles 16 must generally be removed from under or around the flashing 25 and subsequently new shingles 16 must be affixed under or around the flashing 25 and upon the support structure 12.

Re-shingling can cause extensive wear upon the sealant material 27 around the flashing 25 because of the forceful manipulation of the flashing 25 that is required to adequately attach the shingles 16 to the support structure 12. It is appreciated that the term "shingles" is utilized in the description of the present invention for simplicity; however shingles 16 is not meant to be limiting and various other roof coverings or wall coverings may be utilized in place of shingles 16 (e.g. siding, etc.).

For a reason of worn or leaky vent pipe structures 20, there have been many covering structures to attempt to provide a seal between the main pipe 21 and the support structure 12. Many of these covering structures falter for various reasons, such as but not limited to not conforming to varying size vent pipe structures 20, difficulty installing and various others.

The prior covering structures are also generally not configured to fit over the hub 23 of the vent pipe structure 20 thus possibly not forming a complete seal around the vent pipe structure 20. In addition, some prior covering structures attempt to provide a pressurized seal between the extension pipe 22 or the main pipe 21 and the covering structure; however this pressurized seal may be difficult to maintain in cold weather climates.

Another problem with prior covering structures is some may provide a rigid sealing structure (i.e. not allow main pipe 21 to move up or down) between the main pipe 21 and the support structure 12. Often times, a plumber or other technician may need to adjust the pipe from within the building or home when performing repairs or maintenance. This can result in the seal being broken or damaged with the support structure 12 because of the rigid manner in which the extension pipe 22 was originally sealed. Because of the inherent problems with the related art, there is a need for a new and improved vent pipe covering system for efficiently forming a seal between a vent pipe structure 20 and a supporting structure 12.

BRIEF SUMMARY OF THE INVENTION

The general purpose of the present invention is to provide a vent pipe covering system that has many of the advantages of the vent pipe covers mentioned heretofore. The invention generally relates to a cover for a vent pipe which includes a base, a body extending from the base and a coupler extending from the body opposite the base. The base includes a first opening and the body includes a passageway, wherein the passageway longitudinally extends though the body and interconnects with the first opening. The coupler includes a retaining cavity to extend over an outermost end of a pipe extending through the passageway and the first opening, wherein the body and passageway may expand and retract to accommodate various length pipes via an expandable portion of the body.

There has thus been outlined, rather broadly, some of the features of the invention in order that the detailed description thereof may be better understood, and in order that the present contribution to the alt may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction or to the arrangements of the components set forth hi the following description or illustrated in the drawings. The invention is capable of other embodiments and of being practiced and carried out in various ways. Also, it is to be understood that the phraseology and terminology employed herein are for the purpose of the description and should not be regarded as limiting.

An object is to provide a vent pipe covering system for efficiently forming a seal between a vent pipe structure and a supporting structure.

Another object is to provide a vent pipe covering system that attaches to various size pipes.

An additional object is to provide a vent pipe covering system that covers an entire vent pipe extending from the support structure (i.e. roof, etc.).

A further object is to provide a vent pipe covering system that is adjustable to allow for up and down motion of the main pipe and also to conform to various configurations of vent pipes.

Another object is to provide a vent pipe covering system that attaches securely to the vent pipe.

Another object is to provide a vent pipe covering system that is easy to install.

Other objects and advantages of the present invention will become obvious to the reader and it is intended that these objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
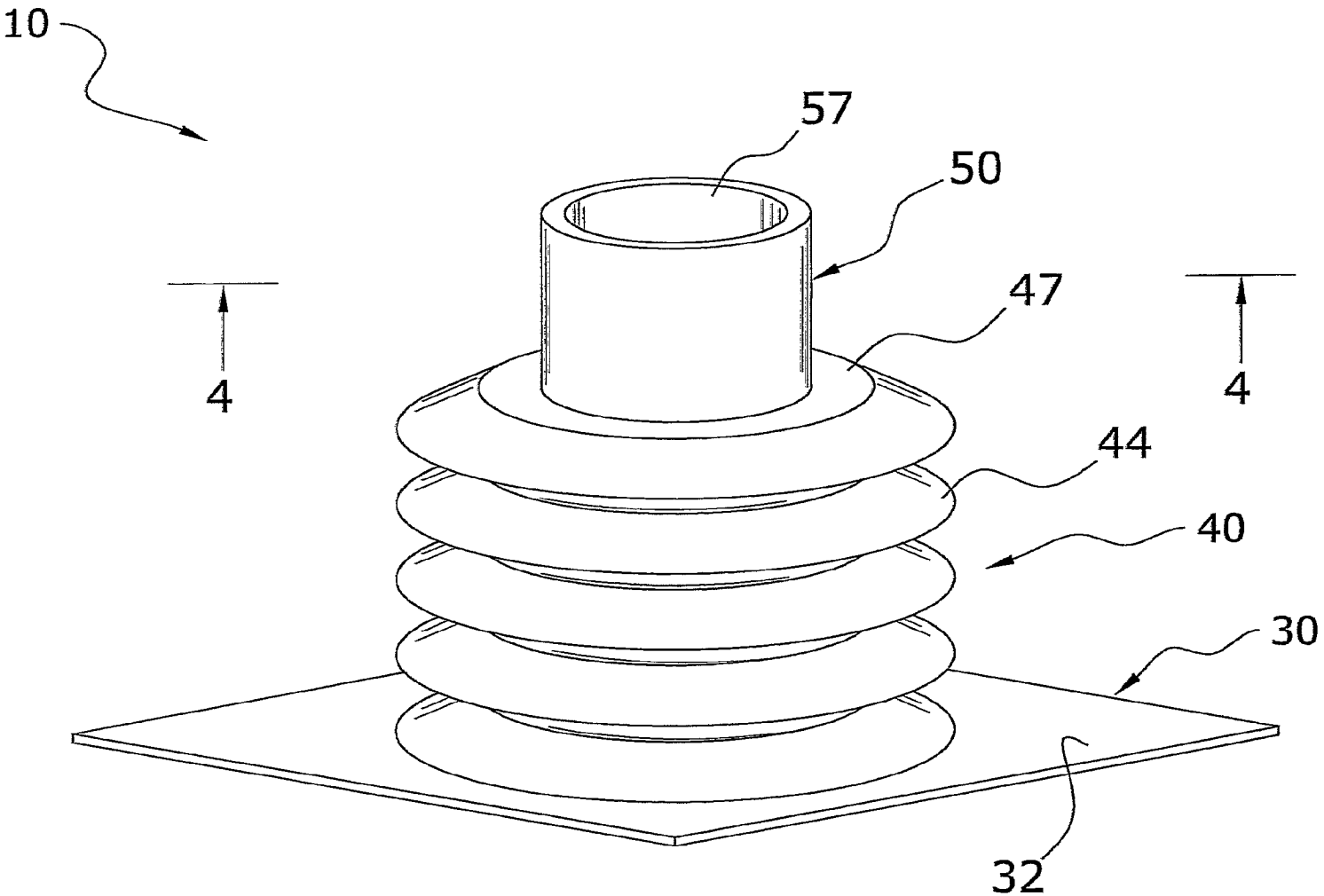
FIG. 1 is an upper perspective view of the present invention in an expanded configuration.

Turning now descriptively to the drawings, in which similar reference characters denote similar elements throughout the several views, FIGS. 1 through 9 illustrate a vent pipe covering system 10, which comprises a base 30, a body 40 extending from the base 30 and a coupler 50 extending from the body 40 opposite the base 30. The base 30 includes a first opening 33 and the body 40 includes a passageway 49, wherein the passageway 49 longitudinally extends through the body 40 and interconnects with the first opening 33. The coupler 50 includes a retaining cavity 55 to extend over an outermost end of a pipe 21 extending through the passageway 49 and the first opening 33, wherein the body 40 and passageway 49 may expand and retract to accommodate various length pipes 21 via an expandable portion 44 of the body 40.

B. Base

Figure 7:
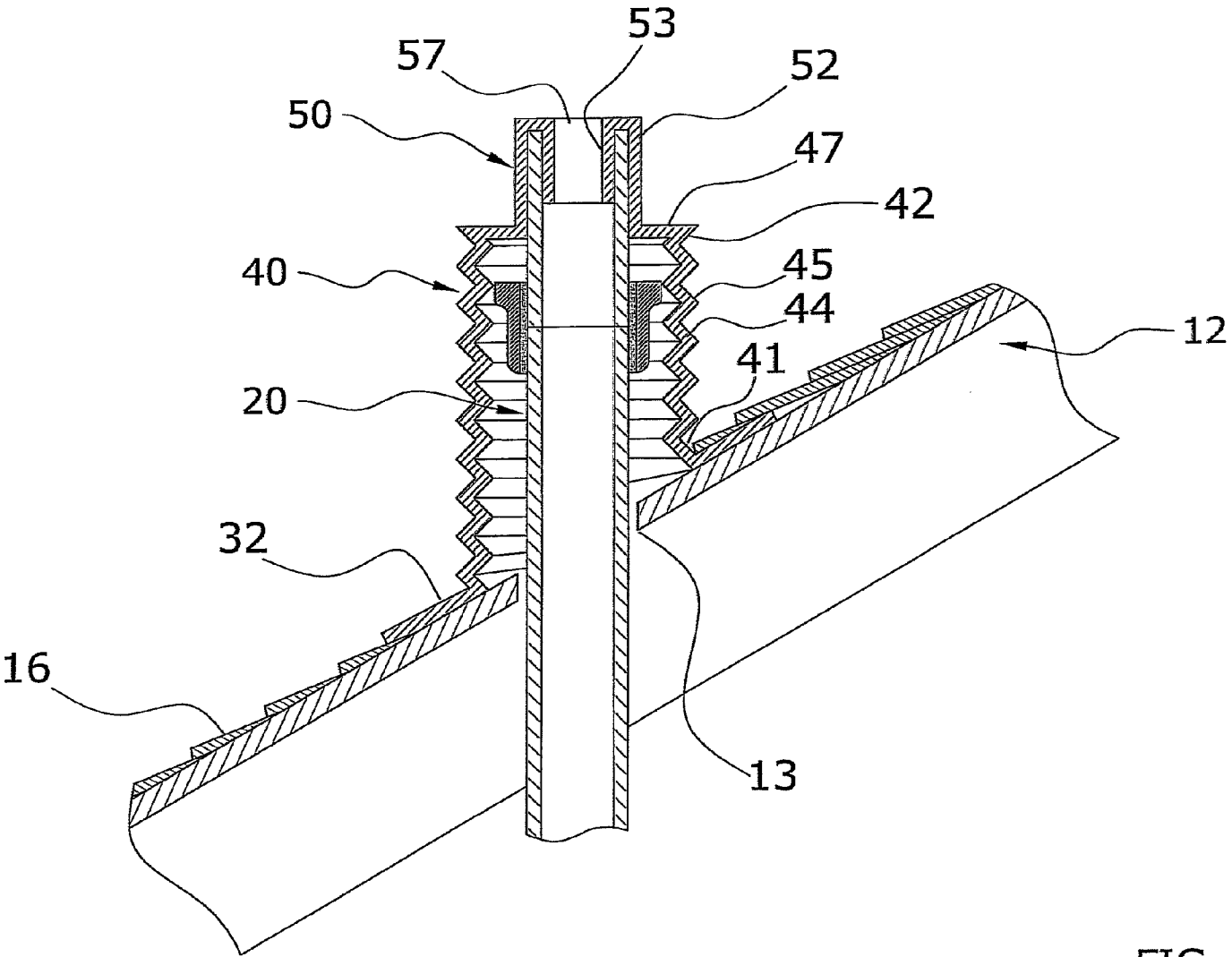
FIG. 7 is a sectional view of the present invention attached upon the vent pipe structure and in an expanded configuration.
Figure 8:
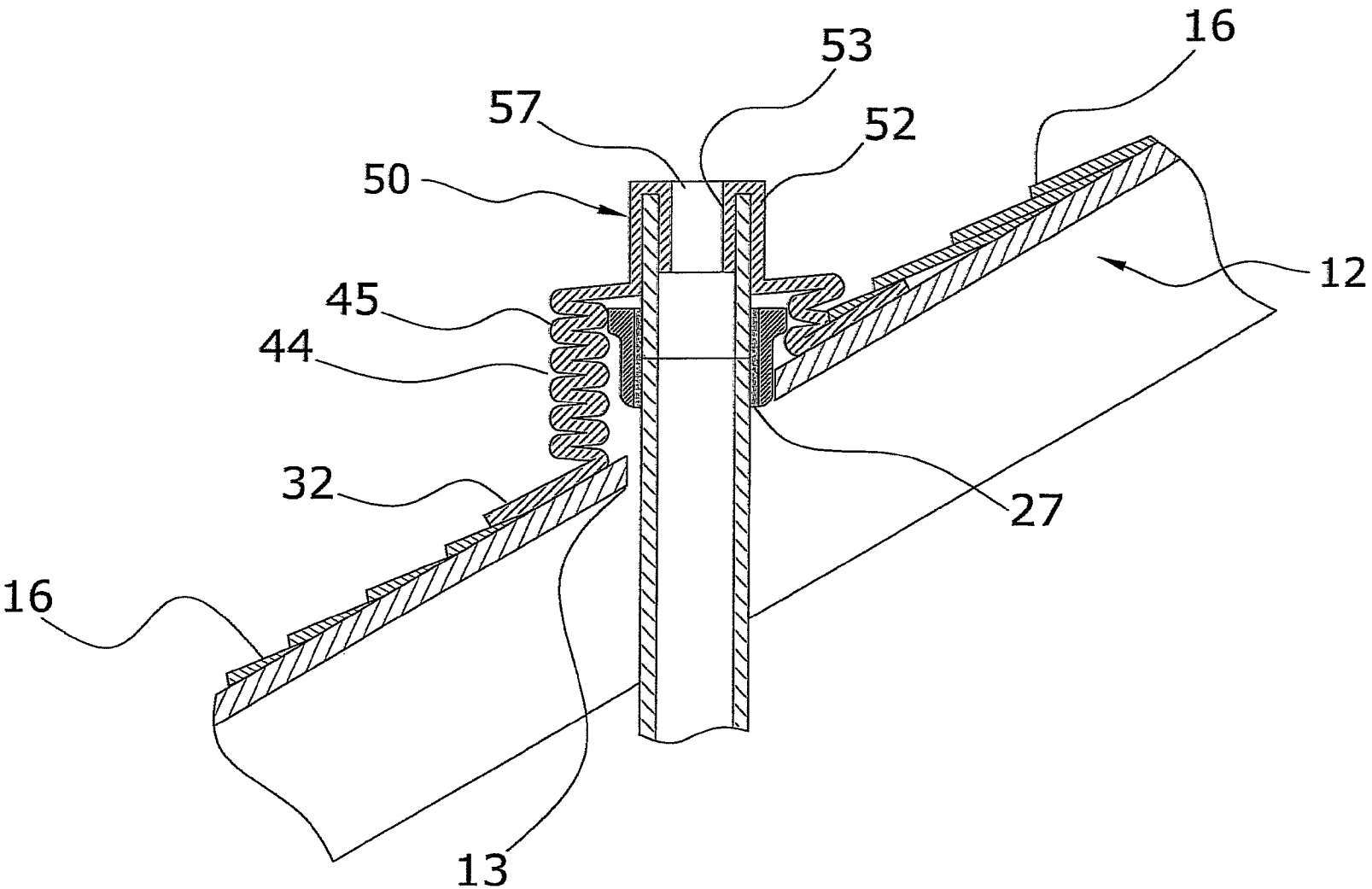
FIG. 8 is a sectional view of the present invention attached upon the vent pipe structure and in a retracted configuration.
Figure 9:
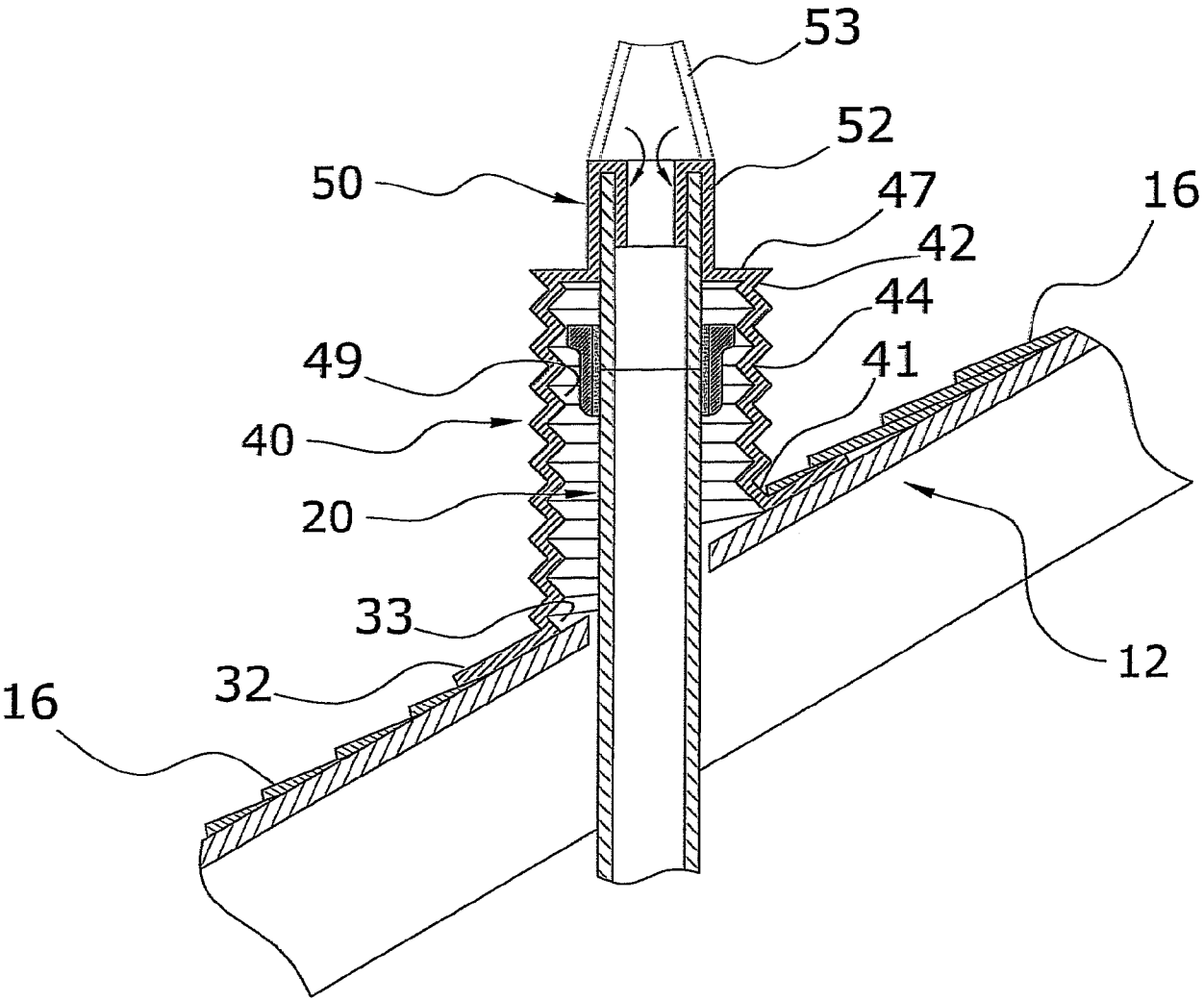
FIG. 9 is a sectional view of the present invention attached upon the vent pipe structure and illustrating an alternate the inner support portion pivoting about the outer support portion.

The base 30 is utilized to attach the present invention to the support structure 12. The base 30 is preferably comprised of a larger perimeter than the body 40 of the present invention, wherein the base 30 acts a flange structure extending from the body 40. The base 30 is preferably positioned adjacent to and attached to an outer surface 14 of the support structure 12 as illustrated in FIGS. 7 through 9. The base 30 is also preferably comprised of a long lasting material that may be utilized in various weather elements and temperatures, such as but not limited to plastic.

Figure 2:
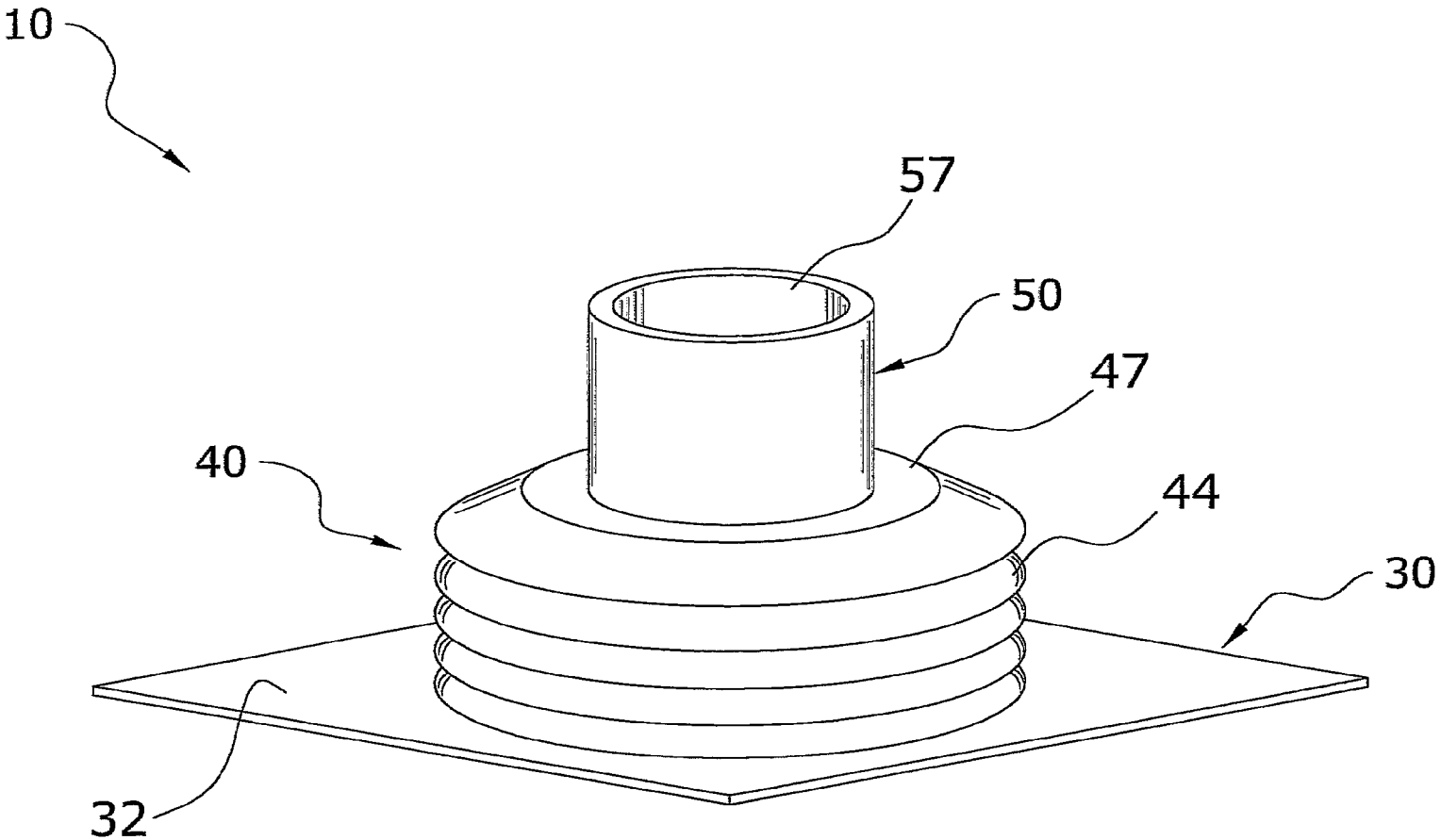
FIG. 2 is an upper perspective view of the present invention in a retracted configuration.
Figure 3:
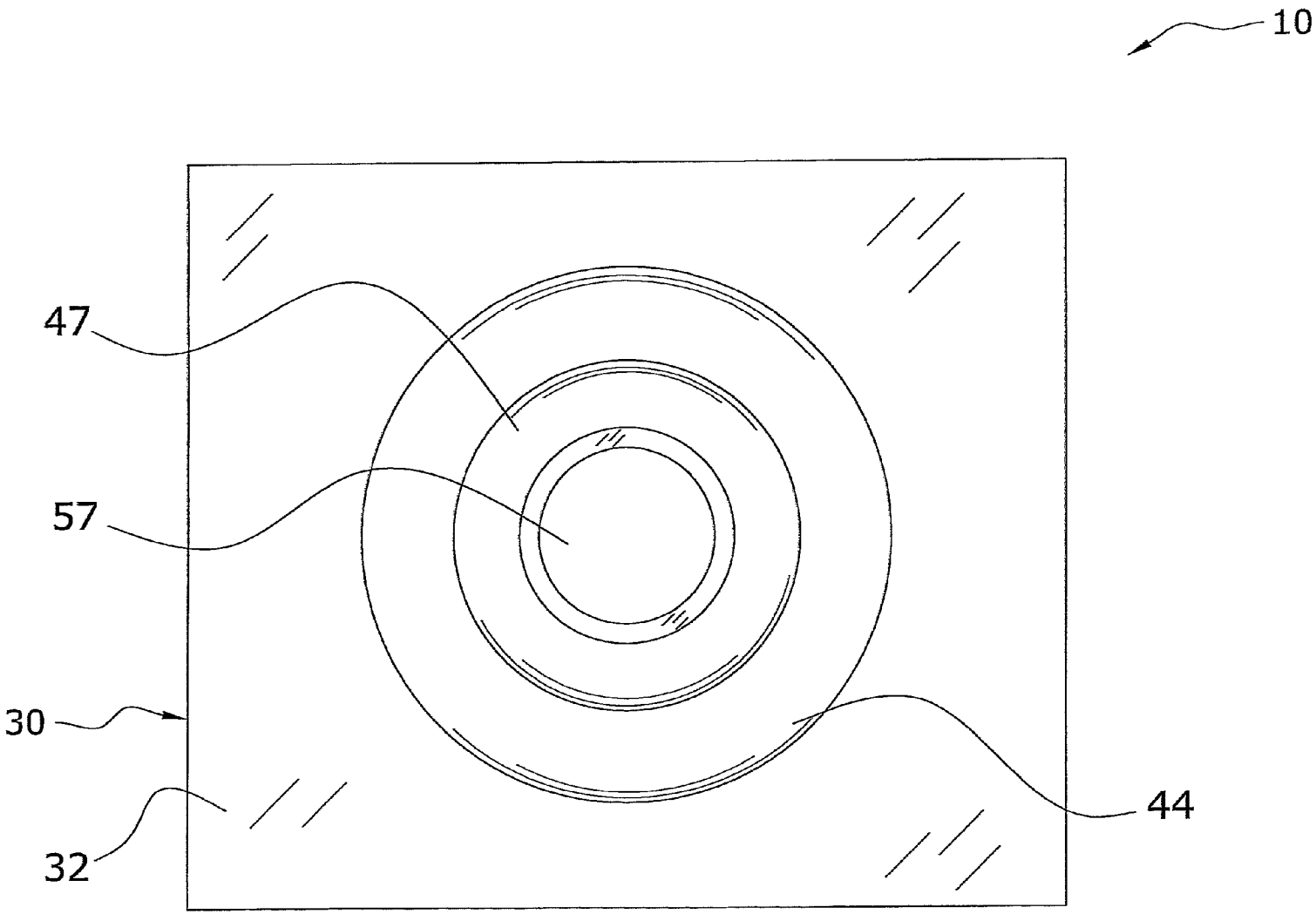
FIG. 3 is a top view of the present invention.
Figure 4:
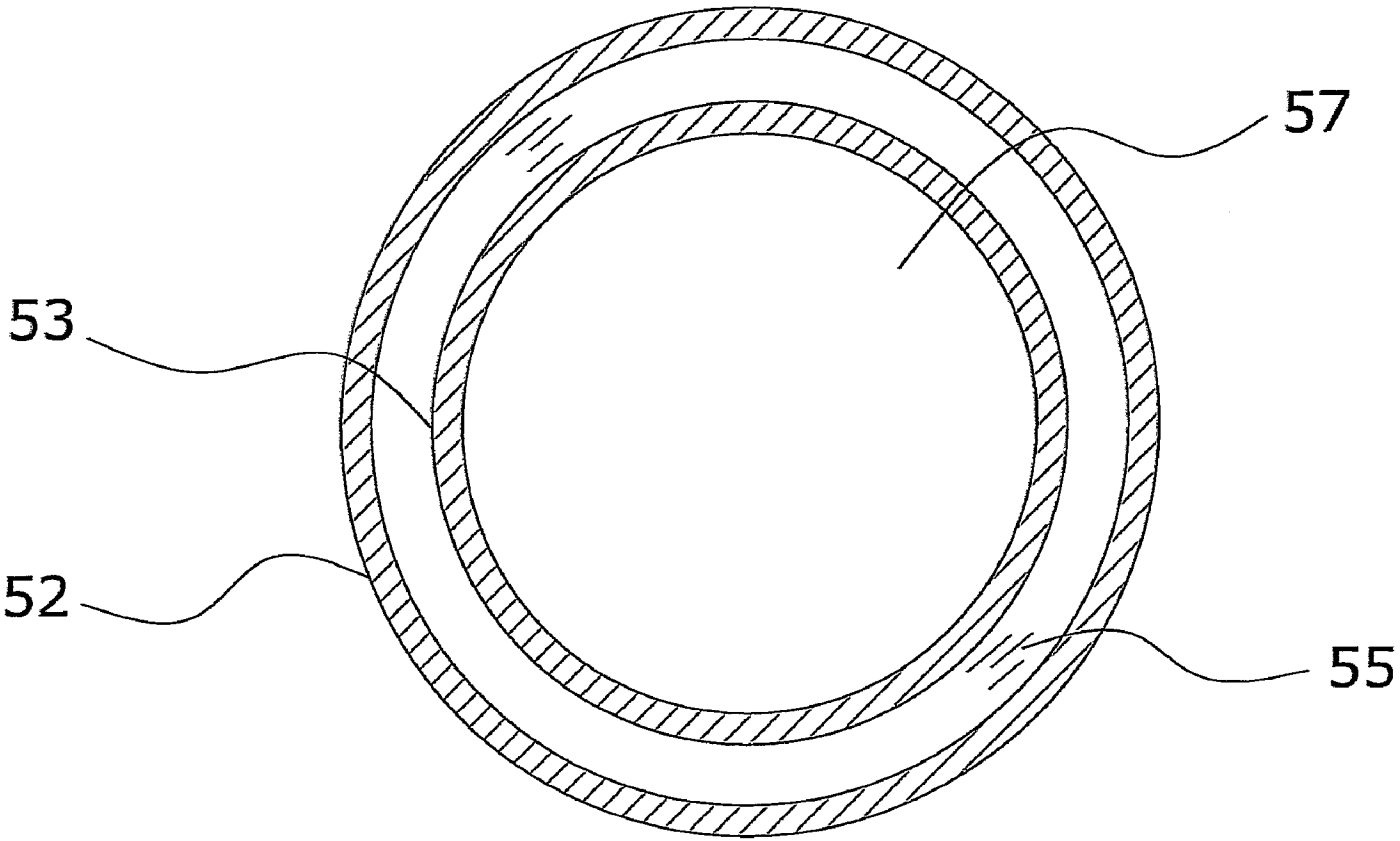
FIG. 4 is a cross-sectional view taken along lines 4-4 of FIG. 1.
Figure 5:
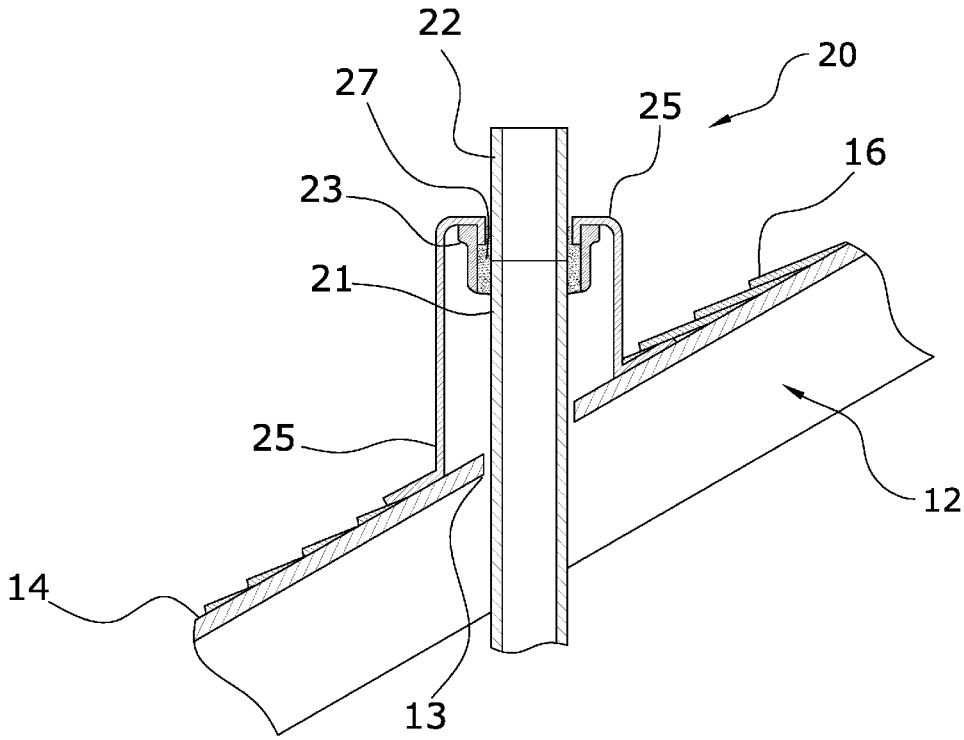
(Prior Art) FIG. 5
FIG. 5 is a sectional view of a prior art assembly of a vent pipe structure.

The base 30 includes a plate 32 as illustrated in FIGS. 1 through 3. The plate 32 is preferably comprised of a flat configuration to be positioned parallel and against the outer surface 14 of the support structure 12. In the preferred embodiment the plate 32 is preferably approximately 18 inches×18 inches in size; however it is appreciated that the plate 32 may be comprised of various other sizes all which efficiently cover the vent opening 13 and attach to the support structure 12.

In the preferred embodiment, the plate 32 is comprised of a square or rectangular shaped configuration; however it is appreciated that the plate 32 may be comprised of various shaped configurations rather than the preferred embodiments such as but not limited to circular. The outer perimeter of the plate 32 is also substantially larger than the diameter of the vent opening 13 of the support structure 12 to prevent water from leaking in the vent opening 13 of the support structure 12.

The base 30 also includes a first opening 33 extending through the base 30 as illustrated in FIGS. 6 through 9. The first opening 33 preferably receives the main pipe 21 of the vent pipe structure 20. The first opening 33 is also preferably concentric with the plate 32 so an equal portion of the plate 32 extends outwardly from around the first opening 33. The first opening 33 is also preferably positioned concentric with the vent opening 13 of the support structure 12 when installing the present invention.

C. Body

The body 40 extends from the base 30 and preferably covers a substantial portion of the vent pipe structure 20 (i.e. main pipe 21, hub 23 and extension pipe 22). The body 40 is preferably comprised of a flexible and expandable configuration so as to adequately attach to various diameter and length vent pipe structures 20 as illustrated in FIGS. 7 and 8. The body 40 is also preferably comprised of a long lasting and rigid material that may be utilized in various weather elements and temperatures, such as but not limited to neoprene, rubber or any elastomeric material.

The body 40 is also preferably concentric with the base 30 and is further concentric with the first opening 33. The body 40 includes a passageway 49 longitudinally extending through the body 40, wherein the passageway 49 receives the majority of the main pipe 21, hub 23 and extension pipe 22 of the vent pipe structure 20. The diameter of the passageway 49 is preferably substantially similar to the diameter of the first opening 33 and is further large enough to easily slide over the main pipe 21, hub 23 and extension pipe 22. The body 40 is further preferably comprised of a substantially tubular shaped configuration.

A first end 41 of the body 40 extends from the base 30 around the first opening 33. The body 40 and the base 30 are preferably comprised of an integrally formed structure to provide a watertight seal between the body 40 and the base 30; however it is appreciated that the body 40 and the base 30 may be comprised of separate structures and a sealant utilized around the first end 41 of the body 40 and the base 30 to prevent water or other substances from leaking within the passageway 49 or first opening 33 of the present invention.

An expandable portion 44 extends between the first end 41 and the second end 42 of the body 40 as illustrated in FIGS. 7 through 9. The expandable portion 44 allows the body 40 to stretch or retract to accommodate various length vent pipe structures 12. The expandable portion 44 preferably includes a plurality of corrugations 45.

In the preferred embodiment the expandable portion 44 may expand and retract from a length of approximately 4 inches to a length of approximately 24 inches; however it is appreciated that the expandable portion 44 may expand and retract to various lengths rather than the preferred embodiment.

The corrugations 45 provide an easy way of expanding or retracting the expandable portion 44 of the body 40. The corrugations 45 also preferably provide a stylish appearance to the present invention. It is appreciated however that the expandable portion 44 may expand and retract utilizing in various manners rather than the preferred embodiment (i.e. use of corrugations 45).

The diameter of the passageway 49 through the expandable portion 44 may be wider to accommodate the hub 23 of the vent pipe structure 20, wherein the expandable portion 44 extends over and around the hub 23. The diameter of the passageway 49 extending within the expandable portion 44 is further preferably approximately 7 inches to efficiently receive the hub 23 within the passageway 49; however it is appreciated that the passageway 49 may be comprised of various other diameters.

Extending inwardly from the expandable portion 44 and opposite the base 30 is preferably a shoulder portion 47. The shoulder portion 47 extends inwardly toward the extension pipe 22 or main pipe 21 (i.e. whichever is at the outermost end of the vent pipe structure 20) so that the coupler 50 may efficiently and securely attach to the extension pipe 22 or main pipe 21 as illustrated in FIGS. 7 through 9.

D. Coupler

The coupler 50 extends from the body 40 and preferably covers a portion of the vent pipe structure 20 near the outermost end of the vent pipe structure 20 with respect to the support structure 12. The coupler 50 further extends over the outermost end of the vent pipe structure 20 and downward (toward the base 30) within the outermost end of the vent pipe structure 20. The coupler 50 is also preferably comprised of a long lasting material that may be utilized in various weather elements and temperatures, such as but not limited to plastic, neoprene, rubber or any elastomeric material.

The coupler 50 is also preferably concentric with the body 40 and is further concentric with the first opening 33 and the passageway 49. The coupler 50 includes a second opening 57 longitudinally extending through the coupler 50, wherein the second opening 57 is positioned within the outermost portion of the vent pipe structure 20 (i.e. extension pipe 22, main pipe 21). The diameter of the second opening 57 is smaller than the diameter of the first opening 33, wherein the portion of the coupler 50 including the second opening 57 simply serves to allow the various gasses traveling through the vent pipe structure 20 to escape into the outside environment. The coupler 50 is further preferably comprised of a substantially tubular shaped configuration.

The coupler 50 and the body 40 are preferably comprised of an integrally formed structure to provide a watertight seal between the coupler 50 and the body 40; however it is appreciated that the coupler 50 and the body 40 may be comprised of separate structures and a sealant utilized around the second end 42 of the body 40 and the coupler 50 to prevent water or other substances from leaking within the passageway 49 of the present invention between the main pipe 21 and the inner wall of the expandable portion 44.

Figure 6:
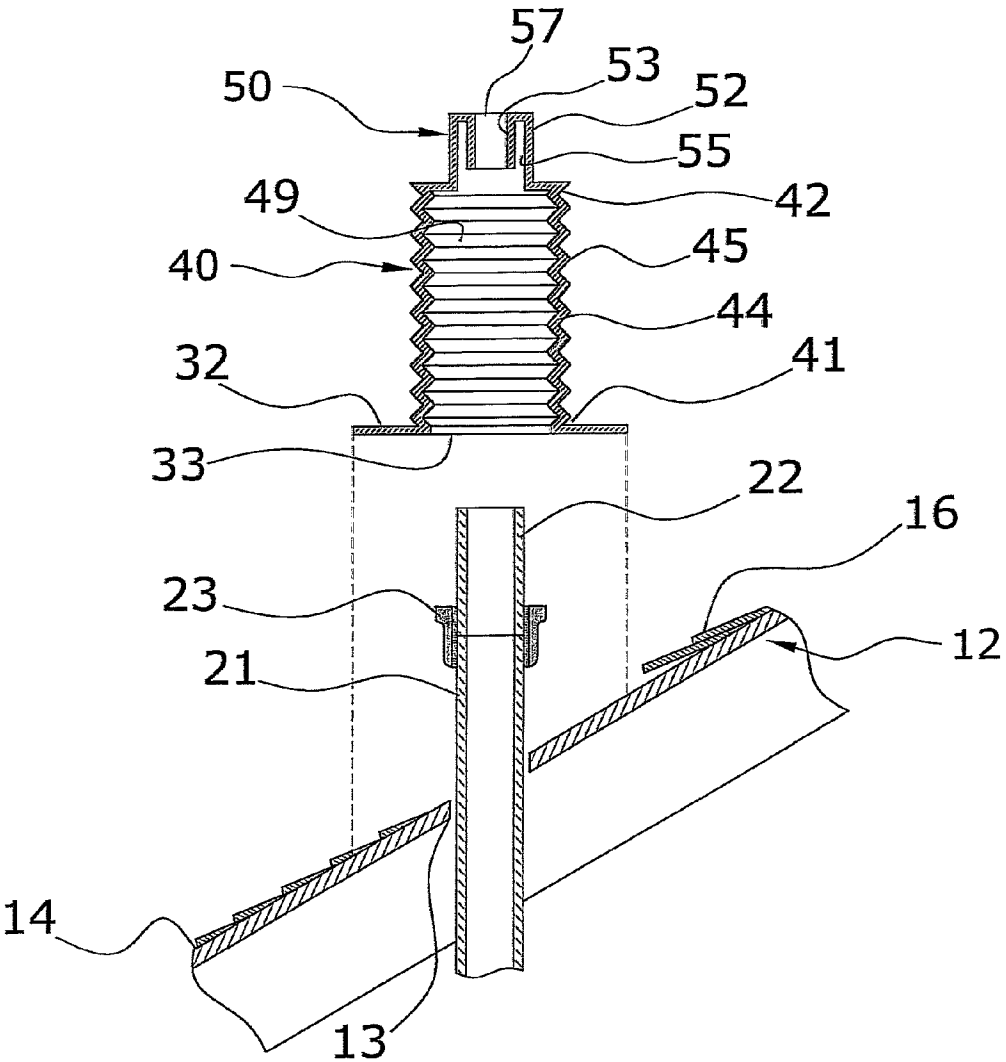
FIG. 6 is a sectional view of the present invention exploded from a vent pipe structure.

The coupler 50 includes an outer support portion 52, an inner support portion 53 extending from the outer support portion 52 and a retaining cavity 55 defined between the outer support portion 52 and the inner support portion 53 as illustrated in FIGS. 6 through 8. The outer support portion 52 extends around an outer perimeter of the vent pipe structure 20 and the inner support portion 53 extends around the inner perimeter of the vent pipe structure 20, wherein the outermost end of the vent pipe structure 20 is simply slid within the retaining cavity 55 between the outer support portion 52 and the inner support portion 53.

The thickness of the retaining cavity 55 is also preferably substantially similar to the thickness of the outermost end of the vent pipe structure 20 so as the coupler 50 may be secured upon the vent pipe structure 20 securely without the use of adhesives or other securing members (e.g. bolts, etc.). The length of the inner support portion 53 is also preferably sufficient to extend within the vent pipe structure 20 and provide a secure attachment of the coupler 50 to the vent pipe structure 20. The inner support portion 53 and the outer support portion 52 are further preferably parallel as illustrated in FIGS. 6 through 8. The outer support portion 52, inner support portion 53 and retaining cavity 55 are also preferably comprised of a ring shaped configuration.

In the preferred embodiment of the present invention the coupler 50 is preformed prior to installation, A cross-sectional shape of the coupler 50 is further preferably comprised of a U-shaped configuration as illustrated in FIGS. 6 through 8. However it is appreciated that the coupler 50 may be comprised of a bendable configuration so that the inner support portion 53 is pivoted inwardly from the outer support portion 52 and within the vent pipe structure 20 at the time of installation of the present invention as illustrated in FIG. 9. Various adhesive substances may subsequently be utilized to secure the inner support portion 53 to the inner surface (around the inner perimeter) of the vent pipe structure 20.

E. Installation of Preferred Embodiment

In use, the flashing 25 of the original or previously installed vent pipe structure 20 is removed from the vent pipe structure 20 and the support structure 12. It is appreciated that the shingles 16 or siding surrounding the flashing 25 may need to be removed or moved away from the flashing 25 to remove the flashing 25. Once the flashing 25 is removed, the present invention is extended over the outermost end of the vent pipe structure 20 so that the base 30 faces the outer surface 14 of the support structure 12 and the coupler 50 extends away from the outer surface 14 of the support structure 12 as illustrated in FIG. 6.

The base 30 is positioned against the outer surface 14 of the support structure 12 and secured to the outer surface 14 via various fastening manners (e.g. nails, adhesive, etc.). The shingles 16 or siding may now be replaced over or around the base 30 in a similar manner as previously done with the flashing 25. Various sealant materials 27 may also be placed around the base 30 to ensure a watertight seal between the base 30 and the support structure 12.

The expandable portion 44 of the body 40 is now expanded or retracted by pulling or pushing on the coupler 50 so that the outermost end of the vent pipe structure 20 is positioned within the retaining cavity 55 of the coupler 50 as illustrated in FIGS. 7 and 8. The present invention is now installed upon and covering the entire vent pipe structure 20.

It is appreciated that the main pipe 21 may be manipulated (e.g. during plumbing maintenance, etc.) without damaging the seal between the base 30 and the support structure 12, wherein the expandable portion 44 of the body 40 is able to expand and retract along with movement of the main pipe 21. The expandable portion 44 also provides a continued force toward the base 30 to keep the coupler 50 secured upon the outermost end of the vent pipe structure 20.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A vent pipe cover for covering a vent pipe structure extending above an outer surface of a supporting roof structure, said vent pipe structure including a main pipe extending through a roof opening in said outer surface and said supporting roof structure, an extension pipe extending outwardly from said main pipe, and a hub connecting said main pipe to said extension pipe, wherein said hub extends laterally outward from said main pipe and said extension pipe thus having an external diameter greater than said main pipe and said extension pipe, said vent pipe cover comprising:

a base having an opening;

said opening adapted to align with said roof opening;

an expandable body having a first end and a second end, said first end connected to said base around said opening of said base and said second end opposite said base relative a longitudinal axis of said expandable body, said first end and said second end located along a substantially common vertical plane;

said expandable body having a passageway extending through from said first end to said second end, said passageway interconnecting with said first opening;

said substantially common vertical plane of said expandable body laterally spaced from said main pipe and said extension pipe to receive said hub within said passageway;

a shoulder portion defining an upper end of said passageway, said shoulder portion extending laterally inward from said second end of said expandable body above said hub; and a coupler vertically extending from a laterally inward end of said shoulder portion, said coupler having a outer support portion and a inner support portion, said outer support portion and said inner support portion defining a retaining cavity and an inner surface, said retaining cavity having a diameter less than said corrugated passageway for receiving an end of said extension pipe, said inner portion extending substantially within said extension pipe;

said base, said expandable body, said shoulder portion, and said coupler comprised of an integral one-piece structure.

2. The vent pipe cover of claim 1, wherein said expandable body is adapted to retract and expand from a first length of approximately 4 inches to a second length of approximately 24 inches.

3. The vent pipe cover of claim 1, wherein said expandable body is comprised of a corrugated structure.

4. The vent pipe cover of claim 3, wherein said passageway extending through said expandable body is shaped in a corrugated structure.

* * * * *